United States Patent [19]

Sather

[11] 3,986,538

[45] *Oct. 19, 1976

[54] STAY CLEAN FUNNEL

[76] Inventor: Kenneth E. Sather, 990 Sonora Drive, Reno, Nev. 89502

[ * ] Notice: The portion of the term of this patent subsequent to June 17, 1992, has been disclaimed.

[22] Filed: Feb. 19, 1975

[21] Appl. No.: 550,991

Related U.S. Application Data

[63] Continuation-in-part of Ser. No. 435,250, Jan. 21, 1974, which is a continuation-in-part of Ser. No. 396,876, Sept. 13, 1973, abandoned.

[52] U.S. Cl. ..... 141/332; 285/DIG. 2; 285/DIG. 4; 285/DIG. 22

[51] Int. Cl.[2] ..... B65B 39/00

[58] Field of Search ..... 141/87, 98, 105–107, 141/114, 199–205, 297–300, 331–345; 285/DIG. 22, DIG. 4, 177, 260, DIG. 2; 24/16, 17, 150 FP, 230 SL, 243 K, 256

[56] References Cited

UNITED STATES PATENTS

| | | | |
|---|---|---|---|
| 3,579,652 | 5/1971 | Ericson | 141/337 |
| 3,899,012 | 8/1975 | Sather | 141/331 |

*Primary Examiner*—Houston S. Bell, Jr.
*Attorney, Agent, or Firm*—Herbert C. Schulze

[57] ABSTRACT

A funnel with an elongated flexible spout is provided wherein a cap is located on the flexible spout near its terminal end whereby the cap can be snapped onto the funnel to keep the funnel and the pouring nozzle clean. This is further characterized by providing a means in which a can of oil or the like may be directly snapped into the funnel and wherein the cap may be independent of the funnel and spout but cooperative therewith to keep the funnel and pouring nozzle clean.

12 Claims, 8 Drawing Figures

STAY CLEAN FUNNEL

CROSS REFERENCE TO RELATED PATENT APPLICATIONS

This application is a continuation-in-part of my application, Ser. No. 435,250, filed Jan. 21, 1974, now which in turn is a continuation-in-part of my application, Ser. No. 396,876, filed Sept. 13, 1973, now abandoned.

BACKGROUND OF THE INVENTION

1. Field of the Invention

This invention is in the general field of funnels and the like, and is particularly directed to funnels for utilization with oils or other fluids wherein substances which tend to form or collect dust and the like are dispensed. It is even more particularly directed to such a funnel wherein any elongated spout is provided with facilities for capping and closing the end of the funnel and spout in such manner that they cannot be contaminated nor contaminate other articles.

2. Description of the Prior Art

There has been a great deal of prior art in the field of dispensing means for various fluids, and particularly means wherein fluids are transferred from one container to another location by the utilization of various intermediate devices, including funnels. For example, I am familiar with such prior art as U.S. Pat. No. 3,724,461; U.S. Pat. No. 1,123,361; U.S. Pat. No. 3,537,456; U.S. Pat. No. 3,476,111; U.S. Pat. No. 3,579,652; and U.S. Pat. No. 2,179,400.

While the prior art together with the commonly known funnels which have been in existence in the public domain many years some of which have an elongated nozzle, the present application is unique in the combination providing a cap cooperative with a funnel which in turn is cooperative with a container, and wherein the cap may alternately be attached, or removably attached to the flexible spout or to the funnel as optionally may be desired.

SUMMARY OF THE INVENTION

Flexible funnels find many uses, particularly at service stations where oil must be frequently poured into a relatively inaccessible opening. The flexible spout end of the funnel permits one to place the mouth of the funnel at a convenient location while the outlet or pouring spout is in the otherwise inaccessible opening.

One difficulty with such funnels is that they frequently become contaminated, particularly if they are used with some sticky substance such as oil. When such a funnel is not in use the oily surface of the interior of the funnel and the pouring spout both act as a holder for dust and dirt so that the next time the funnel is used, the oil or other liquid becomes contaminated.

Further, when such flexible funnels are hung up, they tend to drip so that they are unsightly.

In accordance with the present invention a flexible funnel is provided preferably made of a convoluted tubing wherein a snap action cap is provided on the pouring spout near its terminal end, which cap can be snapped onto the funnel when not in use.

In alternate form, the funnel itself may be provided with a cap, preferably hinged to the open or large end of the funnel which cap in turn will have an opening with a cap or plug suitable to accomodate the pouring nozzle, or the side of the funnel may be provided with a boss suitable to engage the nozzle in which case the cap need not have an opening in it. In this form, the cap is never misplaced, but at the same time is not necessarily located upon the flexible tubing where it can sometimes interfere with the effective use of the tubing in tight places. Additionally, in this form, the funnel may be so designed as to accomodate and snap together with a standard oil can or container of other substance being used.

Thus, the interior of the funnel and the pouring spout remain clean even if they have a sticky or oily substance thereon.

Since the funnel of the present invention forms a circle when cupped together, it is easy to hang up and does not drip.

It is an object of this invention to provide a funnel with an elongated pouring spout suitable to engage with the large end of the funnel in such a manner as to close the large end of the funnel and the pouring spout to prevent contamination when not in use.

Another object of this invention is to provide such a funnel as described wherein there is provisions for cooperative engagement between the large end of the funnel and the container of fluid to be transferred through the funnel.

Another object of this invention is to provide a flexible funnel forming a loop, when closed and not in use such that it may easily be hung upon a nail or other suitable item.

The foregoing and other objects and advantages of this invention will be clear to those skilled in the art upon reading the description of a preferred embodiment which follows, together with a study of the appended drawings.

BRIEF DESCRIPTION OF THE DRAWINGS

In the drawings forming part of this application.

DESCRIPTION OF A PREFERRED EMBODIMENT

Figure 1:
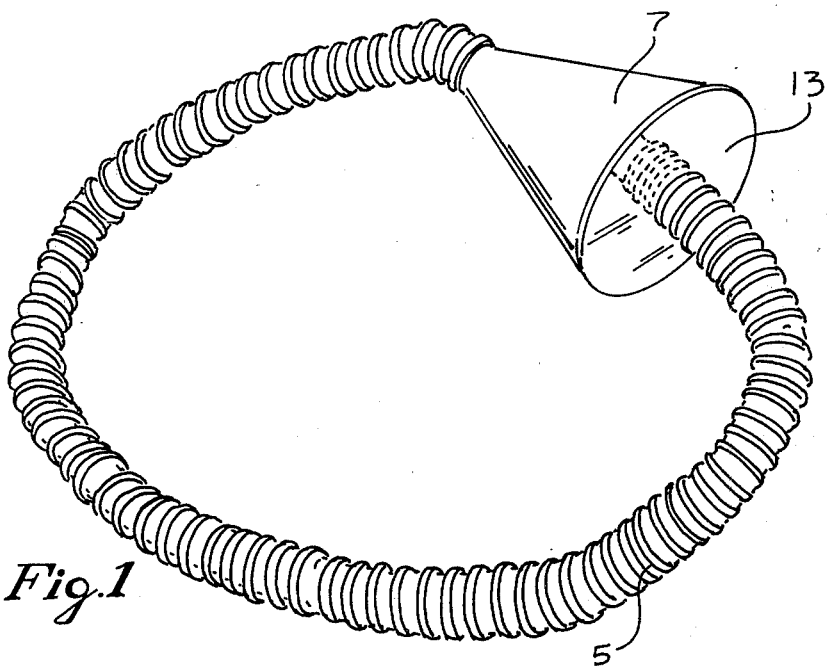
FIG. 1 is a perspective view of a funnel embodying the present invention.
Figure 3:
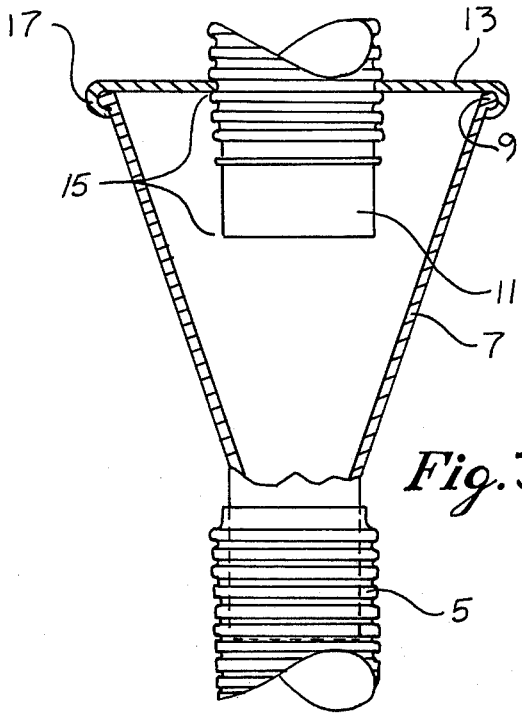
FIG. 3 is an enlarged sectional view of the mouth of the funnel and the pouring spout showing the cap in place.
Figure 2:
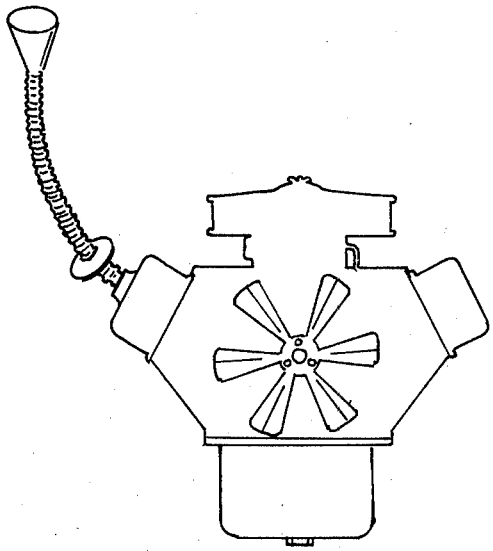
FIG. 2 is a perspective view showing how the funnel of the present invention might be used in pouring oil into a motor.

Referring now to the drawings and particularly FIGS. 1 through 3, by reference characters, the device of the present invention includes a length of a flexible tubing 5. Preferable this flexible tubing is a convoluted plastic tubing although it could be made of various materials and, of course, the material of which it is made must be selected to be inert to the material for which the funnel will be used. Although a convoluted tube, such as that illustrated is preferred, any form of flexible tubing such as flexible rubber or plastic tubing may be employed as well convoluted metal tubing. At one end of the tubing a funnel 7 is attached by any suitable means. In one preferred embodiment of the invention the funnel is molded as an integral part of the tubing although a normal production practice of the funnel would be fabricated separately and attached to the tubing by cementing, clamping or even by mere friction. The funnel 7 may be as the same material as the tubing or may be of a different material and, of course, it need not be flexible so it might be made of a stiff metal. The lip forming the mouth of the funnel preferable has a bead 9 thereon, the purpose for which will be later apparent.

The tubing 5 terminates in a spout end 11 and is suitably not convoluted but it is smooth for easy insertion in an opening of a vehicle or the like. Near the terminal end a cap 13 is provided which is sealed to the tubing 5. Cap 13 is spaced a substantial distance from the terminal end 11 so that the end 11 can easily be inserted in an opening even in an inaccessible place and the cap 13 will not interfere with the operation. In FIG. 3 this distance has been designated as 15 and will be understood that this distance might be even longer than that illustrated, the only limitation being that the parts must fit together so that the terminal end 11 can be inserted into the mouth of the funnel and still permit the cap 13 to engage the rum 9. Of course, by making the terminal end constricted, the distance 15 could be even greater than the depth of the funnel proper. Cap 13 terminates in a rolled over rim 17 which mates with bead 9.

When the funnel is not in use the parts are assembled as is shown in FIGS. 1 and 3 with cap 13 snapped onto funnel 7 with rim 17 engaging bead 9. In this position the interior of the funnel 7 and that portion of the tubing designated 15 will be sealed and thus not be in contact with ambient dust or the like. Further, if these surfaces are oily, there will be no tendence for the liquid to drip from the equipment even when it is hung up. For use it is only necessary to unsnap the cap 13 from the funnel 7 and extend the terminal end 11 into an opening of a vehicle or the like as is shown in FIG. 2.

Figure 4:
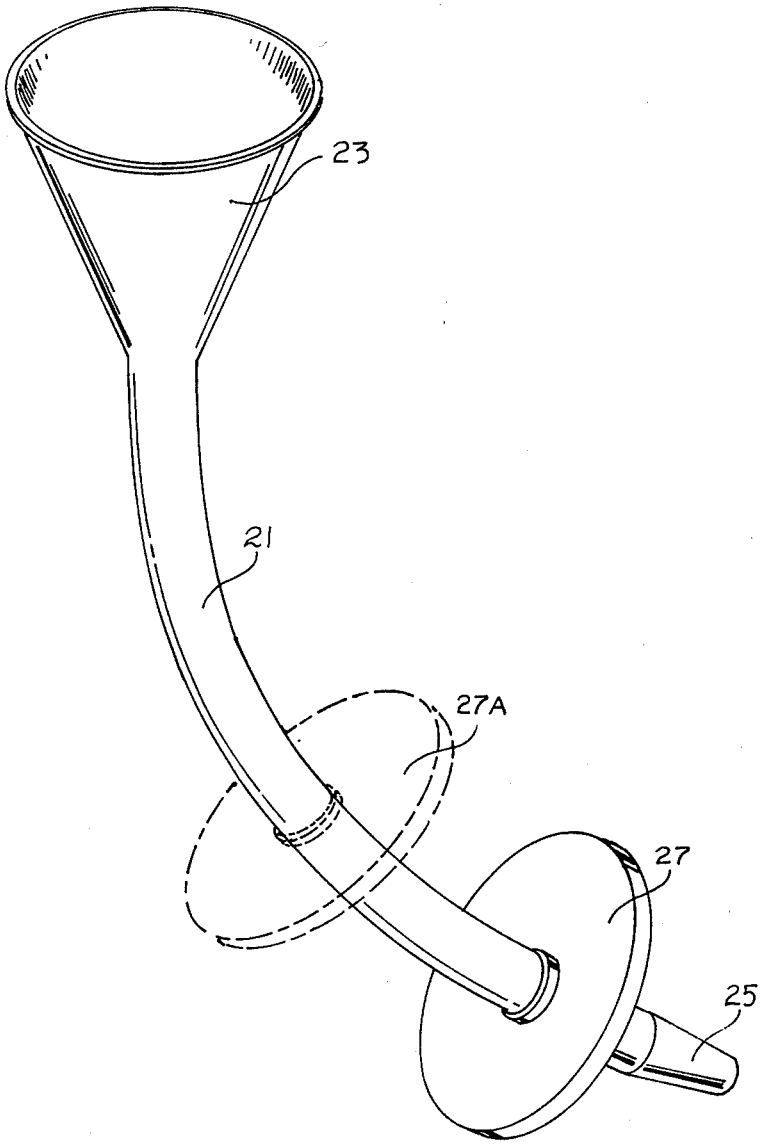
FIG. 4 is a perspective view showing another embodiment of my invention wherein the cap portion is slideably mounted on the hose.

In some instances it has been found that a fixed cap interferes with the use of the funnel when the funnel is to be used in a restriced space such as might be found on the filling openings for power transmissions and lawnmowers. In such instances it is highly desirable that the cap be slideably mounted so that it can be slid out of the way, permitting the nozzle to be inserted in an opening even if the space is very restricted. Thus, referring to FIG. 4, there is shown a structure embodying the present invention wherein the smooth tube 21 is employed with a funnel 23 at one end and a nozzle 25 at the other. A cap 27 is employed as previously described but here the cap 27 is slideably mounted on the tubing 21. Thus, when it is desired to place the cap and funnel in sealing relationship, it can be moved mear the nozzle as is shown in solid lines but, if the structure is to be used in a restricted location, it can be slid up the tubing so that it will be out of the way as is shown in dot-dash line at 27A.

Many variations can be made in the exact structure shown without departing from the spirit of the invention. Although the funnel portion 7 has been shown in a conventional funnel configuration with gradually sloping sidewalls, it could be made in a more cup-like manner with the walls almost parallel. The mouth could be oval rather than round as illustrated. The material from which the tubing and funnel are made could be of flexible metal, plastic, rubber or the like. Although a snap fastening has been shown for fastening the cap 13 to the funnel 7, other fastening means might be employed such as threading, interrupted threads, a friction fit or the like.

Figure 5:
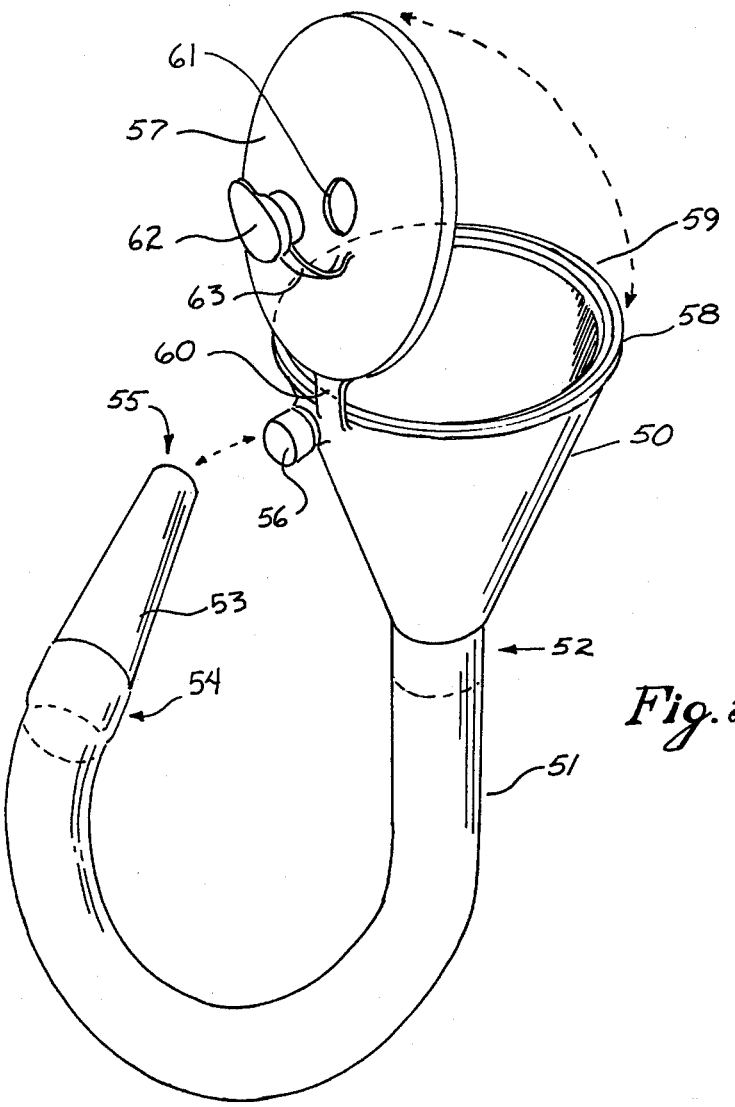
FIG. 5 is a perspective of an alternate embodiment of this invention utilizing a cap attached to the open end of the funnel and a cooperative arrangement for engaging the nozzle.

With attention directed not to FIG. 5, there is shown an alternate embodiment of this invention which has certain particular advantages. A funnel 50 is suitably connected at 52 by adhesive or the like, or by being formed integrally with, a flexible tubing 51 which terminates in a pouring nozzle 53 having an opening 55 in its end for dispensing liquids. The nozzle may be integrally formed, or, as shown here, may be affixed to the tubing 51 by adhesive or the like at 54.

A boss 56 is shown upon the side of the funnel near its large end which is suitable to engage the interior 55 of the pouring nozzle in a tight striction arrangement whereby fluids remaining within the nozzle will not be allowed to drip after use, and contamination cannot get inside the nozzle.

A cap 57 is hinged by plastic strap or the like 60 to the funnel. The cap 57 is so adapted as to fit tightly about the exterior of the large end 58. This is shown to have a bead-like arrangement, and the cap be so adapted as to have a grooved interior edge which will snap onto this bead-like arrangement if desired for a tighter fit. Thus the funnel is effectively sealed.

Figure 6:
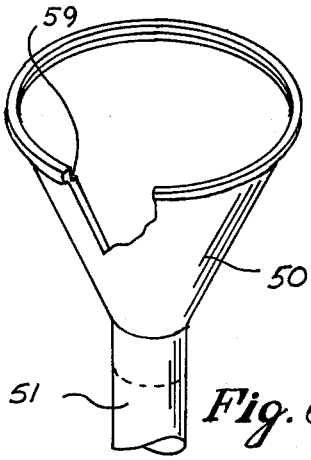
FIG. 6 is a partially broken away partial view of the funnel of FIG. 5.
Figure 7:
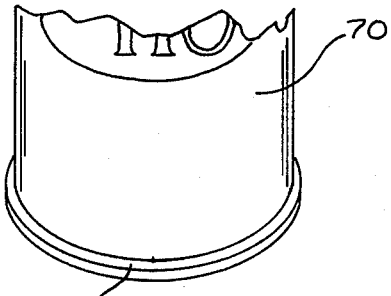
FIG. 7 is a partially broken away perspective of one end of a can of oil.
Figure 8:
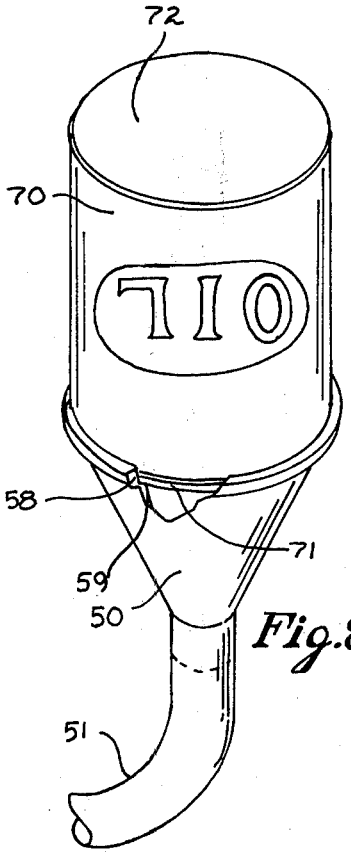
FIG. 8 is a partially broken away perspective of the funnel of FIG. 5 less the oil can of FIG. 7 snapped in place.

A slight shoulder arrangement is provided on the interior at 59 such that it will cooperate with an oil can as is shown in FIGS. 6, 7 and 8 more particularly and will be described below. It will be observed, that an alternative to the closing of this cap could be that the edge of the cap will fit within this shoulder rather than over the exterior of the bead 58.

If desired the boss 56 may be eliminated and optionally a suitable hole 61 may be provided in the cap 57 with a plug 62 fastened by strap 63 to the cap. If this arrangement is used, when the nozzle is desired to be inserted within the cap, it may be inserted directly through the hole. Also, this plug could be eliminated if desired and merely the hole 61 provided to accomplish to tight friction set upon the nozzle 53.

FIG. 6 illustrates the funnel 50 and particularly shows the shoulder 59 at its upper end. In this case it will be noted that the funnel has been broken away at the area of the strapped cap and the boss, therefore they are not visible in this view. FIG. 7 illustrates a portion of a can of oil, or other fluid 70, having a customary bead-like edge 71 on its end.

When a can of oil having such a beaded edge is used in conjunction with the funnel of this embodiment of the invention, it will fit with the funnel in the manner illustrated in FIG. 8. In use it will be first opened, and then snapped into position as shown in FIG. 8 with the bead 71 of the can fitting into the shoulder 59 provided in the funnel 50. Thus when the can has been opened and placed in this position there continues to be a sealed arrangement between the top of the funnel and the dispensing nozzle. If the seal between the bead 58 and the shoulder 59 is essentially perfect, it will become necessary to provide a small perforation in the other end of the can to allow air to enter otherwise the fluid will not drain out properly through the funnel. This hole is illustrated as 72 in FIG. 8.

While the embodiments of this invention shown and described are fully capable of achieving the objects and advantages desired, it is to be understood that such embodiments are for purposes of illustration only and not for purposes of limitation.

I claim:

1. An apparatus for dispensing of fluids comprising: (1) a funnel having one large end suitable to receive liquids and one smaller end suitable to dispense liquids; (2) a flexible tubing cooperatively formed upon the constricted end and extending from a distance therefrom; (3) a dispensing nozzle cooperatively formed upon the end of said tubing not formed upon said funnel suitable to dispense liquids into a receptacle; (4) means cooperatively engaged with the large end of said funnel to seal the same when not receiving liquids; (5) means cooperatively engaged with the large end of said funnel to engage with the dispensing nozzle such that when so engaged, and when the said cap is so engaged, the interior of the flexible tubing, funnel, and nozzle will be sealed against the introduction of foreign materials therein.

2. The apparatus of claim 1 wherein the means to engage the dispensing nozzle comprises a hole in the said cap.

3. The apparatus of claim 1 wherein the means to engage the dispensing nozzle comprises a boss formed adjacent the large end of said funnel and on the exterior thereof, suitable to sealingly interconnect with the said dispensing nozzle.

4. The apparatus of claim 1 wherein the said funnel is provided with shoulder means adjacent the interior of its large end suitable to engage the end of a container of fluid.

5. The device of claim 1 wherein the said cap is hingedly attached adjacent the large end of said funnel in such manner that it may be fastened so as to seal the large end of said funnel or may be opened so as to completely open the large end of said funnel.

6. The device of claim 1 wherein the said cap is cooperatively connected to said tubing.

7. A stay clean, no drip funnel comprising in combination:

a. a funnel having an enlarged mouth end and a constricted end, b. an elongated flexible tubing member forming a continuation of the restricted end of said funnel, said elongated member having a terminal end suitable for insertion in an orifice, c. a cap adapted to snap over the large mouth end of the funnel, d. said cap having a central opening with the elongated flexible tubing extending through said opening to retain said cap thereon, e. said cap being mounted on said flexible member near said terminal end whereby said terminal end is free and extends beyond said cap for a sufficient distance to permit the same to be inserted in an orifice, and f. wherein said terminal end can be inserted in the enlarged mouth end of the funnel to provide a closed structure.

8. The structure of claim 7 wherein said funnel opening and said cap are of circular configuration.

9. The structure of claim 7 wherein said flexible member is constructed of a convoluted flexible inert plastic tubing.

10. The structure of claim 7 wherein said funnel mouth terminates in a lip and wherein said cap has an inturned rim portion whereby said cap can be pushed over said rim and snapped into place thereon.

11. The structure of claim 7 wherein the cap is fixed onto flexible member.

12. The structure of claim 7 wherein said cap is slideably mounted on said flexible member.

* * * * *